US007452233B1

(12) United States Patent
Michelsen

(10) Patent No.: US 7,452,233 B1
(45) Date of Patent: Nov. 18, 2008

(54) PLUG CONNECTION SECURING SYSTEM

(76) Inventor: Lars Michelsen, 2320 Marina Bay Dr. East, Apartment #207, Fort Lauderdale, FL (US) 33312

( * ) Notice: Subject to any disclaimer, the term of this patent is extended or adjusted under 35 U.S.C. 154(b) by 0 days.

(21) Appl. No.: 11/779,690

(22) Filed: Jul. 18, 2007

(51) Int. Cl.
*H01R 13/62* (2006.01)

(52) U.S. Cl. ..... 439/369

(58) Field of Classification Search ..... 439/369, 439/372, 357, 373
See application file for complete search history.

(56) References Cited

U.S. PATENT DOCUMENTS 1,899,360 A * 2/1933 Roudebush et al. ..... 439/358
4,917,625 A * 4/1990 Haile ..... 439/358
5,454,729 A * 10/1995 Wen-Te ..... 439/357
6,398,579 B1 * 6/2002 Banas et al. ..... 439/372
7,040,931 B1 * 5/2006 Achtner et al. ..... 439/651
7,078,624 B1 * 7/2006 Stewart ..... 174/66

* cited by examiner

*Primary Examiner*—Phuong K Dinh

(57) ABSTRACT

A plug connection securing system includes a male plug member that includes a male body with a front face and a peripheral wall. A cord extends into the male body. A plurality of male connections extends outwardly of the front face. A female plug member includes a female body with a forward face and a perimeter wall. A cord extends into the female body. A plurality of female connections extends inwardly of the forward face and receives the male connections. Each of a pair of arms has a first end pivotally attached to the peripheral wall. Each of the arms has a bend therein. Second ends of the arms are selectively positionable in front of the front face. A perimeter lip is attached to the female body and forms at least a pair of oppositely positioned shoulders. Each of the arms removably engages one of the shoulders.

7 Claims, 3 Drawing Sheets

PLUG CONNECTION SECURING SYSTEM

BACKGROUND OF THE INVENTION

1. Field of the Invention

The present invention relates to plug securing devices and more particularly pertains to a new plug securing device for ensuring that male and female plugs are secured together in a connected manner to prevent them from being accidentally pulled apart.

2. Description of the Prior Art

The use of plug securing devices is known in the prior art. While these devices fulfill their respective, particular objectives and requirements, the need remains for a male and female plug system which ensures that once connected together, the male and female plugs will not pull apart from each other. This is particularly useful for a person who is climbing on a ladder with an electric power tool connected to an extension cord. This system will prevent the extension cord from disengaging with the power tool and thus prevent the need for the person to climb down the ladder and reconnect the power tool with the extension cord.

SUMMARY OF THE INVENTION

The present invention meets the needs presented above by generally comprising a male plug member that includes a male body with a front face and a peripheral wall extending away from the front face. A cord extends into the male body. A plurality of male connections extends outwardly of the front face. A female plug member includes a female body with a forward face and a perimeter wall extending away from the forward face. A cord extends into the female body. A plurality of female connections extends inwardly of the forward face. The male connections are removably extendable into the female connections to electrically couple the cord of the male plug member to the cord of the female plug member to define an engaged position. Each of a pair of arms has a first end and a second end. The first ends are pivotally attached to the peripheral wall of the male plug member. Each of the arms has a bend therein positioned between the first and second ends of a respective one of the arms. The second ends are selectively positionable in front of the front face. A perimeter lip is attached to the female body at a juncture of the perimeter wall and the forward face. The perimeter lip forms at least a pair of oppositely positioned shoulders. Each of the arms removably engages one of the shoulders to retain the male and female plugs in the engaged position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
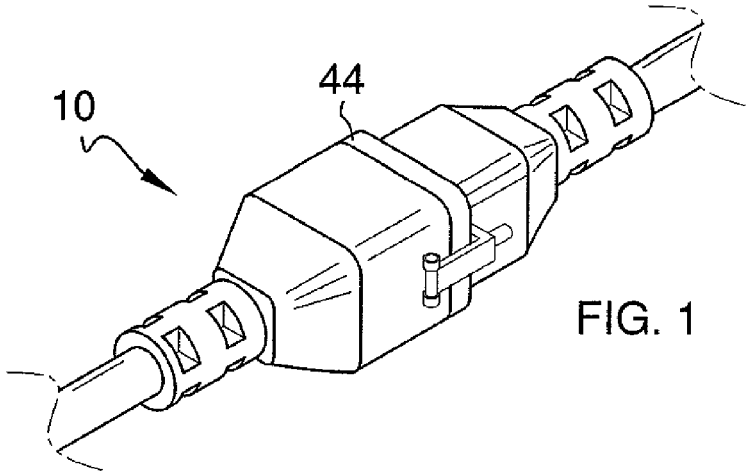
FIG. 1 is a perspective view of a plug connection securing system according to the present invention in an engaged position.
Figure 2:
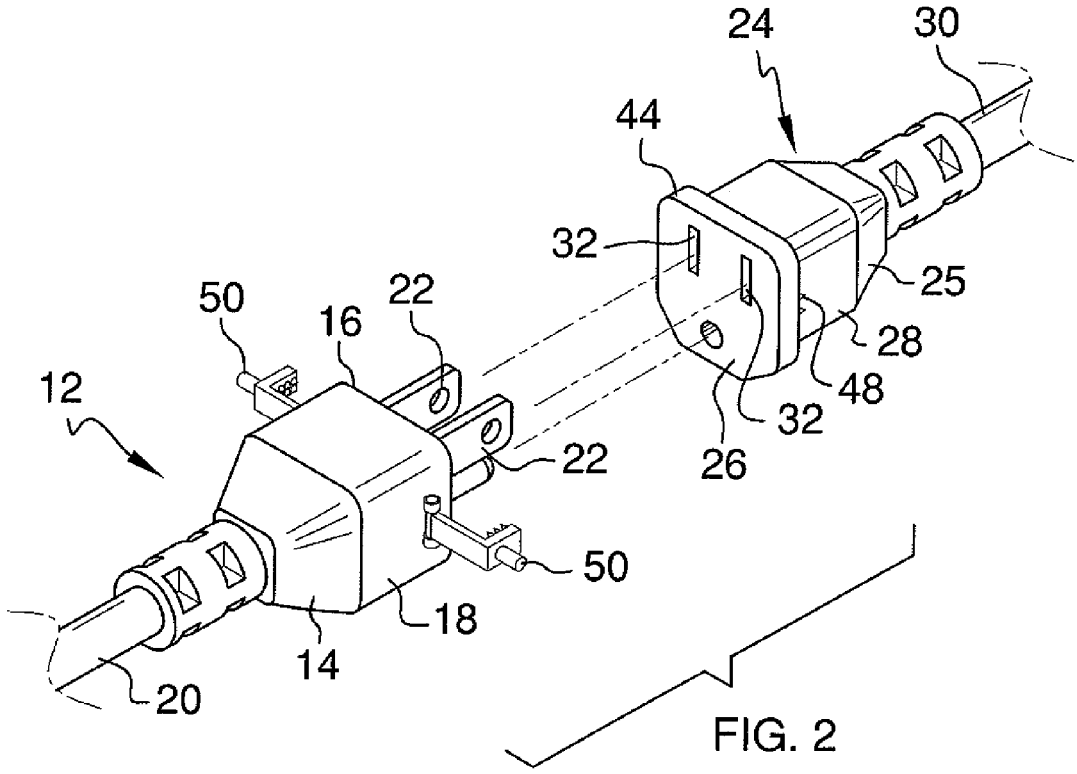
FIG. 2 is a perspective view of the present invention in a disengaged position.
Figure 3:
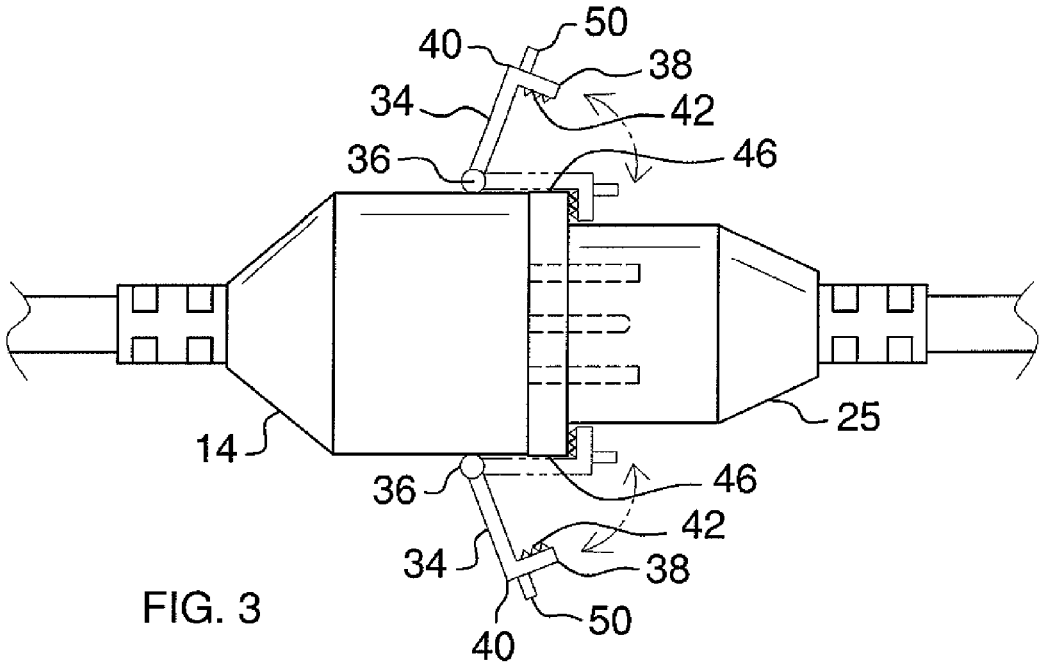
FIG. 3 is a top view of the present invention.

With reference now to the drawings, and in particular to FIGS. 1 through 5 thereof, a new plug securing device embodying the principles and concepts of the present invention and generally designated by the reference numeral 10 will be described.

Figure 4:
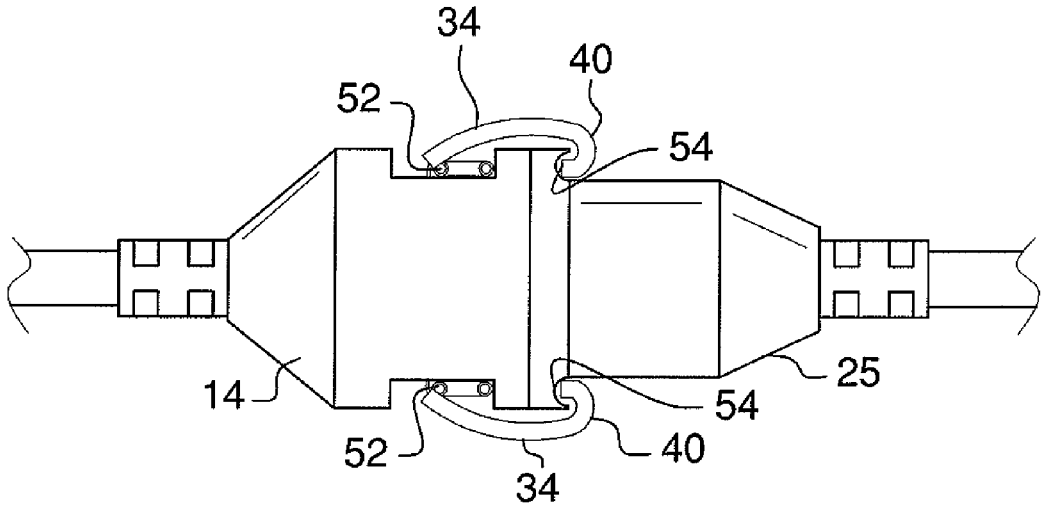
FIG. 4 is a top view of a second embodiment the present invention.
Figure 5:
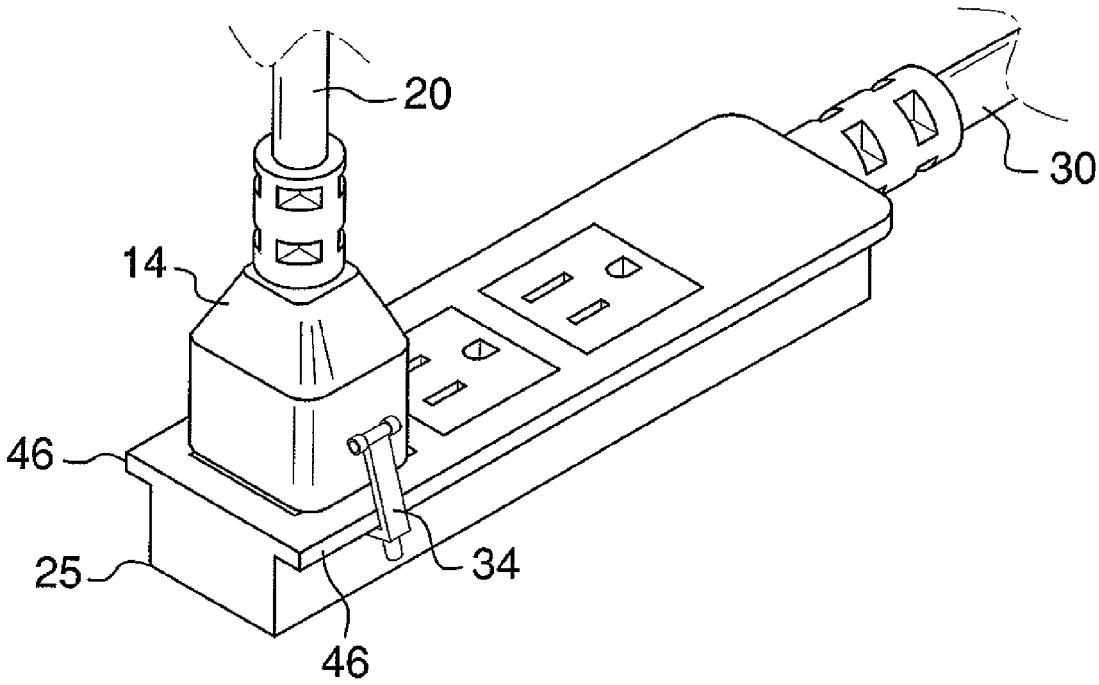
FIG. 5 is a perspective view of a third embodiment of the present invention.

As best illustrated in FIGS. 1 through 5, the plug connection securing system 10 generally comprises a male plug member 12 including a male body 14 with a front face 16 and a peripheral wall 18 extending away from the front face 16. A cord 20 extends into the male body 14. A plurality of male connections 22 extends outwardly of the front face 16. A female plug member 24 includes a female body 25 that has a forward face 26 and a perimeter wall 28 extending away from the forward face 26. A cord 30 extends into the female body 25. A plurality of female connections 32 extends inwardly of the forward face 26. The male 12 and female 24 plug members are conventional and the male connections 22 are removably extendable into the female connections 32 to electrically couple the cord 20 of the male plug member 12 to the cord 30 of the female plug member 24 to define an engaged position. As shown in FIG. 5, the female plug member 24 may include a plurality of female bodies 25 coupled together.

A pair of arms 34 is provided. Each of the arms 34 has a first end 36 and a second end 38. Each of the first ends 36 is pivotally attached to the peripheral wall 18 of the male plug member 12. The arms 34 each have a bend 40 therein positioned between the first 36 and second ends 38 of a respective one of the arms 34. The second ends 38 are selectively positionable in front of the front face 16. The bends 40 in the arms 34 each perpendicular bends. Each of the arms 34 has a plurality of teeth 42 thereon. The teeth 42 are positioned between associated ones of the bends 40 and the second ends 38. The teeth 42 extend toward the front face 16 when the second ends 38 are positioned forward of the front face 16. The arms 34 are positioned on opposite sides of the male body 14 with respect to each other.

A perimeter lip 44 is attached to the female body 25 at a juncture of the perimeter wall 28 and the forward face 26. The perimeter lip 28 forms at least a pair of oppositely positioned shoulders 46. Each of the arms 34 removably engages one of the shoulders 46 to retain the male 12 and female 24 plugs in the engaged position. The peripheral lip 44 has a plurality of catches 48 thereon. The catches 48 are positioned to frictionally couple with the teeth 42 when the arms 34 are engaged with the shoulders 46. A pair of grips 50 is provided. Each of the arms 34 has one of the grips 50 attached thereto to facilitate the removal of the arms 34 from the shoulders 46.

A second embodiment is shown in FIG. 4 and includes a pair of biasing members 52. Each of the arms 34 has one of the biasing members 52 attached thereto. The biasing members 52 are springs that bias the arms toward the shoulders 46. Each of the shoulders 46 has an arcuate depression 54 therein. The bends 40 in the arms 34 of the second embodiment are arcuate and form the arms 34 into a hook shape. The second ends 38 extend into and frictionally engage one of the depressions 54.

In use, the male 12 and female 24 plug members are engaged with each other. The arms 34 are then extended around the shoulders 46 to prevent the male plug member 12 from being easily removable from the female plug member 24. It should be understood that the male 12 and female 24 plug members are electrically coupled with their respective cords 20, 30 to either an electrically powered device or another male or female plug member.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plug connection securing system comprising:

a male plug member including a male body having a front face and a peripheral wall extending away from said front face, a cord extending into said male body, a plurality of male connections extending outwardly of said front face;

a female plug member including a female body having a forward face and a perimeter wall extending away from said forward face, a cord extending into said female body, a plurality of female connections extending inwardly of said forward face, said male connections being removably extendable into said female connections to electrically couple said cord of said male plug member to said cord of said female plug member to define an engaged position;

a pair of arms, each of said arms having a first end and a second end, each of said first ends being pivotally attached to said peripheral wall of said male plug member, each of said arms having a bend therein positioned between said first and second ends of a respective one to said arms, said second ends being selectively positionable in front of said front face a perimeter lip being attached to said female body at a juncture of said perimeter wall and said forward face, said perimeter lip forming at least a pair of oppositely positioned shoulders, each of said arms removably engaging one of said shoulders to retain said male and female plugs in said engaged positioning; and each of said arms having a plurality of teeth thereon, said teeth being positioned between associated ones of said bends and said second ends, said teeth extending toward said front face when said second ends are positioned forward of said front face, said peripheral lip having a plurality of catches thereon, said catches being positioned to frictionally couple with said teeth when said arms are engaged with said shoulders.

2. The system according to claim 1, wherein said bends in said arms are each a perpendicular bend.

3. The system according to claim 1, further including a pair of grips, each of said arms having one of said grips attached thereto, said grips facilitating removing of said arms from said shoulders.

4. The system according to claim 1, further including a pair of grips, each of said arms having one of said grips attached thereto, said grips facilitating removing of said arms from said shoulders.

5. The system according to claim 1, further including a pair of biasing members, each of said arms having one of said biasing members attached thereto, said biasing members biasing said arms toward said shoulders.

6. The system according to claim 5, wherein each of said shoulders have arcuate depressions therein, said bends in said arms being arcuate and forming said arms into a hook shape, said second ends extending into and frictionally engaging one of said depressions.

7. A plug connection securing system comprising:

a male plug member including a male body having a front face and a peripheral wall extending away from said front face, a cord extending into said male body, a plurality of male connections extending outwardly of said front face;

a female plug member including a female body having a forward face and a perimeter wall extending away from said forward face, a cord extending into said female body, a plurality of female connections extending inwardly of said forward face, said male connections being removably extendable into said female connections to electrically couple said cord of said male plug member to said cord of said female plug member to define an engaged position;

a pair of arms, each of said arms having a first end and a second end, each of said first ends being pivotally attached to said peripheral wall of said male plug member, each of said arms having a bend therein positioned between said first and second ends of a respective one of said arms, said second ends being selectively positionable in front of said front face, said bends in said arms each being a perpendicular bend, each of said arms having a plurality of teeth thereon, said teeth being positioned between associated ones of said bends and said second ends, said teeth extending toward said front face when said second ends are positioned forward of said front face, said arms being positioned on opposite sides of said male body with respect to each other;

a perimeter lip being attached to said female body at a juncture of said perimeter wall and said forward face, said perimeter lip forming at least a pair of oppositely positioned shoulders, each of said arms removably engaging one of said shoulders to retain said male and female plugs in said engaged position, said peripheral lip having a plurality of catches thereon, said catches being positioned to frictionally couple with said teeth when said arms are engaged with said shoulders; and a pair of grips, each of said arms having one of said grips attached thereto, said grips facilitating removing of said arms from shoulders.

* * * * *